US008249861B2

(12) United States Patent
Li et al.

(10) Patent No.: US 8,249,861 B2
(45) **Date of Patent: *Aug. 21, 2012**

(54) HIGH FREQUENCY COMPRESSION INTEGRATION

(75) Inventors: Xueman Li, Burnaby (CA); Phillip Hetherington, Port Moody (CA); Alex Escott, Vancouver (CA)

(73) Assignee: QNX Software Systems Limited, Kanata, Ontario (CA)

( * ) Notice: Subject to any disclaimer, the term of this patent is extended or adjusted under 35 U.S.C. 154(b) by 1419 days.

This patent is subject to a terminal disclaimer.

(21) Appl. No.: 11/645,079

(22) Filed: Dec. 22, 2006

(65) Prior Publication Data

US 2007/0174050 A1 Jul. 26, 2007

Related U.S. Application Data

(63) Continuation-in-part of application No. 11/298,053, filed on Dec. 9, 2005, now Pat. No. 8,086,451, which is a continuation-in-part of application No. 11/110,556, filed on Apr. 20, 2005, now Pat. No. 7,813,931.

(51) Int. Cl.
*G10L 19/14* (2006.01)
*G10L 21/00* (2006.01)
*H04R 25/00* (2006.01)

(52) U.S. Cl. ..... 704/205; 704/201; 704/206; 704/225; 381/316; 381/321

(58) Field of Classification Search ..... 704/205, 704/208, 201, 206, 225; 381/316, 321
See application file for complete search history.

(56) References Cited

U.S. PATENT DOCUMENTS

| | | | |
|---|---|---|---|
| 4,130,734 | A | 12/1978 | Lee |
| 4,170,719 | A | 10/1979 | Fujimura |
| 4,255,620 | A | 3/1981 | Harris et al. |
| 4,343,005 | A | 8/1982 | Han et al. |
| 4,374,304 | A | 2/1983 | Flanagan |
| 4,600,902 | A | 7/1986 | Lafferty |
| 4,630,305 | A | 12/1986 | Borth et al. |
| 4,700,360 | A | 10/1987 | Visser |
| 4,741,039 | A | 4/1988 | Bloy |

(Continued)

FOREIGN PATENT DOCUMENTS

EP 0 054 450 A1 6/1982

(Continued)

OTHER PUBLICATIONS

Walter Kellermann, Strategies for Combining Acoustic Echo Cancellation and Adaptive Beamforming Microphone Arrays, 1997, IEEE, pp. 219-222.*

(Continued)

*Primary Examiner* — Jialong He
(74) *Attorney, Agent, or Firm* — Brinks Hofer Gilson & Lione

(57) ABSTRACT

A speech enhancement system that improves the intelligibility and the perceived quality of processed speech includes a frequency transformer and a spectral compressor. The frequency transformer converts speech signals from the time domain to the frequency domain. The spectral compressor compresses a pre-selected portion of the high frequency band and maps the compressed high frequency band to a lower band limited frequency range. The speech enhancement system may be built into, may be a unitary part of, or may be configured to interface other systems that process audio or high frequency signals.

29 Claims, 14 Drawing Sheets

U.S. PATENT DOCUMENTS

| | | | | |
|---|---|---|---|---|
| 4,953,182 | A | 8/1990 | Chung | |
| 5,335,069 | A | 8/1994 | Kim | |
| 5,345,200 | A | 9/1994 | Reif | |
| 5,396,414 | A | 3/1995 | Alcone | |
| 5,416,787 | A | 5/1995 | Kodama et al. | |
| 5,455,888 | A | 10/1995 | Iyengar et al. | |
| 5,471,527 | A | 11/1995 | Ho et al. | |
| 5,497,090 | A | 3/1996 | Macovski | |
| 5,581,652 | A | 12/1996 | Abe et al. | |
| 5,715,363 | A * | 2/1998 | Tamura et al. | 704/205 |
| 5,771,299 | A | 6/1998 | Melanson | |
| 5,774,841 | A | 6/1998 | Salazar et al. | |
| 5,790,671 | A * | 8/1998 | Cooper | 381/57 |
| 5,822,370 | A * | 10/1998 | Graupe | 375/240 |
| 5,828,756 | A * | 10/1998 | Benesty et al. | 381/66 |
| 5,867,815 | A | 2/1999 | Kondo et al. | |
| 5,950,153 | A | 9/1999 | Ohmori et al. | |
| 5,999,899 | A | 12/1999 | Robinson | |
| 6,115,363 | A | 9/2000 | Oberhammer et al. | |
| 6,144,244 | A | 11/2000 | Gilbert | |
| 6,154,643 | A | 11/2000 | Cox | |
| 6,157,682 | A | 12/2000 | Oberhammer | |
| 6,195,394 | B1 | 2/2001 | Arbeiter et al. | |
| 6,208,958 | B1 | 3/2001 | Cho et al. | |
| 6,226,616 | B1 | 5/2001 | You et al. | |
| 6,275,596 | B1 | 8/2001 | Fretz et al. | |
| 6,295,322 | B1 | 9/2001 | Arbeiter et al. | |
| 6,311,153 | B1 | 10/2001 | Nakatoh et al. | |
| 6,504,935 | B1 | 1/2003 | Jackson | |
| 6,523,003 | B1 | 2/2003 | Chandran et al. | |
| 6,539,355 | B1 | 3/2003 | Omori et al. | |
| 6,577,739 | B1 | 6/2003 | Hurtig et al. | |
| 6,615,169 | B1 | 9/2003 | Ojala et al. | |
| 6,675,144 | B1 | 1/2004 | Tucker et al. | |
| 6,680,972 | B1 | 1/2004 | Lijeryd et al. | |
| 6,681,202 | B1 | 1/2004 | Miet et al. | |
| 6,691,083 | B1 | 2/2004 | Breen | |
| 6,691,085 | B1 | 2/2004 | Rotola-Pukkila et al. | |
| 6,704,711 | B2 | 3/2004 | Gustafsson et al. | |
| 6,721,698 | B1 | 4/2004 | Hariharan et al. | |
| 6,741,966 | B2 | 5/2004 | Romesburg | |
| 6,766,292 | B1 | 7/2004 | Chandran et al. | |
| 6,778,966 | B2 * | 8/2004 | Bizjak | 704/500 |
| 6,819,275 | B2 | 11/2004 | Reefman et al. | |
| 6,895,375 | B2 | 5/2005 | Malah et al. | |
| 7,062,040 | B2 * | 6/2006 | Faller | 379/406.11 |
| 7,069,212 | B2 | 6/2006 | Tanaka et al. | |
| 7,139,702 | B2 | 11/2006 | Tsushima et al. | |
| 7,248,711 | B2 * | 7/2007 | Allegro et al. | 381/316 |
| 7,283,967 | B2 | 10/2007 | Nishio et al. | |
| 7,333,618 | B2 | 2/2008 | Shuttleworth et al. | |
| 7,333,930 | B2 | 2/2008 | Baumgarte | |
| 2002/0107593 | A1 * | 8/2002 | Rabipour et al. | 700/94 |
| 2002/0111796 | A1 | 8/2002 | Nemoto | |
| 2002/0128839 | A1 | 9/2002 | Lindgren et al. | |
| 2002/0138268 | A1 | 9/2002 | Gustafsson | |
| 2003/0009327 | A1 | 1/2003 | Nilsson et al. | |
| 2003/0050786 | A1 | 3/2003 | Jax et al. | |
| 2003/0055636 | A1 | 3/2003 | Katuo et al. | |
| 2003/0093278 | A1 | 5/2003 | Malah | |
| 2003/0093279 | A1 | 5/2003 | Malah et al. | |
| 2003/0158726 | A1 | 8/2003 | Philippe et al. | |
| 2004/0022404 | A1 | 2/2004 | Negishi | |
| 2004/0057574 | A1 * | 3/2004 | Faller | 379/387.01 |
| 2004/0158458 | A1 | 8/2004 | Sluijter et al. | |
| 2004/0166820 | A1 | 8/2004 | Sluijter et al. | |
| 2004/0170228 | A1 | 9/2004 | Vadde | |
| 2004/0172242 | A1 * | 9/2004 | Seligman et al. | 704/225 |
| 2004/0174911 | A1 | 9/2004 | Kim et al. | |
| 2004/0175010 | A1 | 9/2004 | Allegro et al. | |
| 2004/0181393 | A1 | 9/2004 | Baumgarte | |
| 2004/0190734 | A1 | 9/2004 | Kates | |
| 2004/0264610 | A1 * | 12/2004 | Marro et al. | 375/347 |
| 2004/0264721 | A1 | 12/2004 | Allegro et al. | |
| 2005/0047611 | A1 * | 3/2005 | Mao | 381/94.7 |
| 2005/0159944 | A1 * | 7/2005 | Beerends | 704/225 |
| 2005/0175194 | A1 | 8/2005 | Anderson | |
| 2005/0195988 | A1 * | 9/2005 | Tashev et al. | 381/92 |
| 2005/0261893 | A1 | 11/2005 | Toyama et al. | |
| 2005/0286713 | A1 * | 12/2005 | Gunn et al. | 379/406.04 |
| 2006/0098810 | A1 * | 5/2006 | Kim | 379/406.14 |
| 2006/0241938 | A1 * | 10/2006 | Hetherington et al. | 704/208 |
| 2006/0247922 | A1 * | 11/2006 | Hetherington et al. | 704/208 |
| 2007/0198268 | A1 * | 8/2007 | Hennecke | 704/270 |
| 2007/0280472 | A1 * | 12/2007 | Stokes, III et al. | 379/406.01 |
| 2007/0282602 | A1 * | 12/2007 | Fujishima et al. | 704/207 |

FOREIGN PATENT DOCUMENTS

| | | | |
|---|---|---|---|
| EP | 0 497 050 | A3 | 8/1992 |
| EP | 0 706 299 | A2 | 10/1996 |
| EP | 0 706 299 | A3 | 10/1998 |
| GB | 1 424 133 | | 2/1976 |
| JP | 59-122135 | | 7/1984 |
| JP | 06-303166 | | 10/1994 |
| JP | 07-147566 | | 6/1995 |
| JP | 08-321792 | | 12/1996 |
| JP | 06-164520 | | 6/1997 |
| JP | 10-124098 | | 5/1998 |
| JP | 2001-196934 | | 7/2001 |
| JP | 2001-521648 | | 11/2001 |
| JP | 2002-073088 | | 3/2002 |
| JP | 2002-244686 | A | 8/2002 |
| KR | 10-1998-0073078 | A | 5/1998 |
| KR | 10-2002-0024742 | A | 4/2002 |
| KR | 2002-0066921 | | 8/2002 |
| WO | WO 98/06090 | A1 | 2/1998 |
| WO | WO 99/14986 | | 3/1999 |
| WO | WO 01/18960 | A1 | 3/2001 |
| WO | WO 2005004111 | A1 * | 1/2005 |
| WO | WO 2005/015952 | A1 | 2/2005 |

OTHER PUBLICATIONS

Iser, B. and Schmidt, G., "Neural Networks Versus Codebooks in an Application for Bandwidth Extension of Speech Signals" Temic Speech Dialog Systems, Soeflinger Str. 100, 89077 Ulm, Germany, Proceedings of Eurospeech 2003 (16 Pages).

Wolters, M. et al., "A Closer Look into MPEA-4 High Efficiency AAC" Convention Paper, Audio Engineering Society, Presented at the 115$^{th}$ Convention, Oct. 10-13, 2003, New York, NY, USA (16 Pages).

Patrick, P.J. et al., "Frequency Compression of 7.6 kHz Speech into 3.3 kHz Bandwidth," *IEEE Trans. Commun.*, vol. COM-31, No. 5, May 1983, pp. 692-701.

Patrick, P.J. et al.; "Frequency Compression of 7.6 kHz Speech into 3.3 kHz Bandwidth"; IEEE Transactions on Communications, vol. Com-31, No. 5; May 1983; pp. 692-701.

* cited by examiner

HIGH FREQUENCY COMPRESSION INTEGRATION

PRIORITY CLAIM

This application is a continuation-in-part of U.S. application Ser. No. 11/298,053 "System for Improving Speech Intelligibility Through High Frequency Compression," filed Dec. 9, 2005 now U.S. Pat. No. 8,086,451, which is a continuation-in-part of U.S. application Ser. No. 11/110,556 "System for Improving Speech Quality and Intelligibility," filed Apr. 20, 2005 now U.S. Pat. No. 7,813,931. The disclosures of the above applications are incorporated herein by reference.

BACKGROUND OF THE INVENTION

1. Technical Field

The invention relates to communication systems, and more particularly, to systems that improve the intelligibility of speech.

2. Related Art

Many communication devices acquire, assimilate, and transfer speech signals. Speech signals pass from one system to another through a communication medium. All communication systems, especially wireless communication systems, suffer bandwidth limitations. In some systems, including some telephone systems, the clarity of the speech signals depend on the systems ability to pass high and low frequencies. While many low frequencies may lie in a pass band of a communication system, the system may block or attenuate high frequency signals, including the high frequency components found in some unvoiced consonants.

Some communication devices may overcome this high frequency attenuation by processing the spectrum. These systems may use a speech/silence switch and a voiced/unvoiced switch to identify and process unvoiced speech. Since transitions between voiced and unvoiced segments may be difficult to detect, some systems are not reliable and may not be used with real-time processes, especially systems susceptible to noise or reverberation. In some systems, the switches are expensive and they create artifacts that distort the perception of speech. Therefore, there is a need for a system that improves the perceptible sound of speech in a limited frequency range.

SUMMARY

A speech enhancement system improves the intelligibility of a speech signal. The system includes a frequency transformer and a spectral compressor. The frequency transformer converts speech signals from the time domain into the frequency domain. The spectral compressor compresses a preselected portion of the high frequency band and maps the compressed high frequency band to a lower band limited frequency range. The speech enhancement system may be built into, may be a unitary part of, or may be configured to interface other systems that process audio or high frequency signals.

Other systems, methods, features, and advantages of the inventions will be, or will become, apparent to one with skill in the art upon examination of the following figures and detailed description. It is intended that all such additional systems, methods, features, and advantages be included within this description, be within the scope of the inventions, and be protected by the following claims.

BRIEF DESCRIPTION OF THE DRAWINGS

The inventions can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
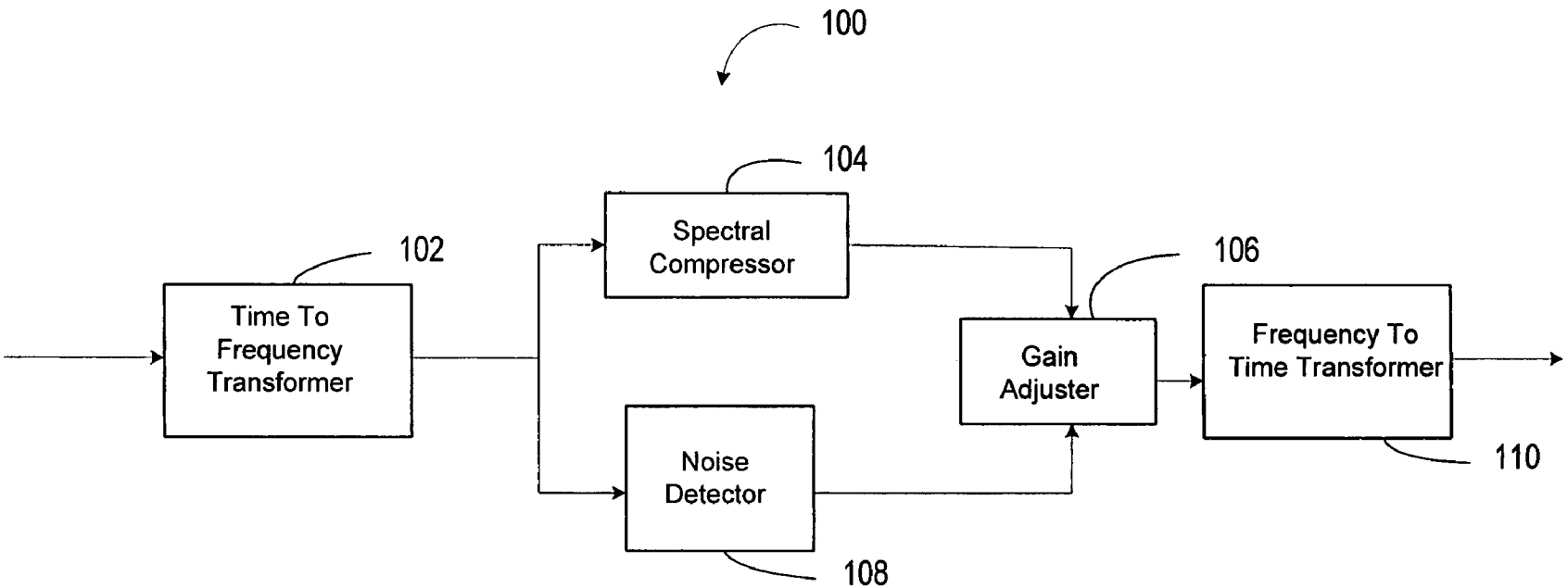
FIG. 1 is a block diagram of a speech enhancement system.

Enhancement logic improves the intelligibility of processed speech. The logic may identify and compress speech segments to be processed. Selected voiced and/or unvoiced segments may be processed and shifted to one or more frequency bands. To improve perceptual quality, adaptive gain adjustments may be made in the time or frequency domains. The system may adjust the gain of some or the entire speech segments. The versatility of the system allows the logic to enhance speech before or after it is passed to a second system in some applications. Speech and audio may be passed to an Automatic Speech Recognition (ASR) engine, an acoustic echo canceller (AEC), a fixed or an adaptive beamformer, or other linear or non-linear audio applications wirelessly or through a tangible communication bus that may capture and extract voice in the time and/or frequency domains.

Any bandlimited device may benefit from these systems. The systems may be built into, may be a unitary part of, or may be configured to interface any bandlimited device. The systems may be a part of or interface radio applications such as air traffic control devices (which may have similar bandlimited pass bands), radio intercoms (mobile or fixed systems for crews or users communicating with each other), audio systems, and Bluetooth enabled devices, such as headsets, that may have a limited bandwidth across one or more Bluetooth links. The system may also be a part of other personal or commercial limited bandwidth communication systems that may interface vehicles, commercial applications, or devices that may control user's homes (e.g., such as a voice control.)

In some alternatives, the systems may precede or follow other processes or systems. Some systems may use adaptive filters, other circuitry or programming that may disrupt the behavior of the enhancement logic. In some systems the enhancement logic precedes and may be coupled to an echo canceller (e.g., a system or process that attenuates or substantially attenuates an unwanted sound). When an echo is detected or processed, the enhancement logic may be automatically disabled or mitigated and later enabled to prevent the compression and mapping, and in some instances, a gain adjustment of the echo. In other systems, the enhancement logic may follow (e.g., directly follow or follow after an intermediate system or application) an echo cancellation system to avoid or minimize the unwanted compression of undesired echoes. When the system precedes or is coupled to a beamformer, a controller or the beamformer (e.g., a signal combiner) may control the operation of the enhancement logic (e.g., automatically enabling, disabling, or mitigating the enhancement logic in some of the systems). In some systems, this control may further suppress distortion such as multi-path distortion and/or co-channel interference. Some systems may compress a frequency band that lies outside of the band limited range that a beamformer may process before applying a beamforming technique. In other systems or applications, the enhancement logic is coupled to a post adaptive system or process. In some applications, the enhancement logic is controlled or interfaced to a controller that prevents or minimizes the enhancement of an undesirable signal.

FIG. 1 is a block diagram of enhancement logic 100. The enhancement logic 100 may encompass hardware and/or software capable of running on or interfacing one or more operating systems. In the time domain, the enhancement logic 100 may include transform logic and compression logic. In FIG. 1, the transform logic comprises a frequency transformer 102. The frequency transformer 102 provides a time to frequency transform of an input signal. When received, the frequency transformer is programmed or configured to convert the input signal into its frequency spectrum. The frequency transformer may convert an analog audio or speech signal into a programmed range of frequencies in delayed or real time. Some frequency transformers 102 may comprise a set of narrow bandpass filters that selectively pass certain frequencies while eliminating, minimizing, or dampening frequencies that lie outside of the pass bands. Other enhancement systems 100 use frequency transformers 102 programmed or configured to generate a digital frequency spectrum based on a Fast Fourier Transform (FFT). These frequency transformers 102 may gather signals from a selected range or an entire frequency band to generate a real time, near real time or delayed frequency spectrum. In some enhancement systems, frequency transformers 102 automatically detect and convert audio or speech signals into a programmed range of frequencies.

The compression logic comprises a spectral compression device or spectral compressor 104. The spectral compressor 104 maps a wide range of frequency components within a high frequency range to a lower, and in some enhancement systems, narrower frequency range. In FIG. 1, the spectral compressor 104 processes an audio or speech range by compressing a selected high frequency band and mapping the compressed band to a lower band limited frequency range. When applied to speech or audio signals transmitted through a communication band, such as a telephone bandwidth, the compression transforms and maps some high frequency components to a band that lies within the telephone or communication bandwidth. In one enhancement system, the spectral compressor 104 maps the frequency components between a first frequency and a second frequency almost two times the highest frequency of interest to a shorter or smaller band limited range. In these enhancement systems, the upper cutoff frequency of the band limited range may substantially coincide with the upper cutoff frequency of a telephone or other communication bandwidth.

Figure 2:
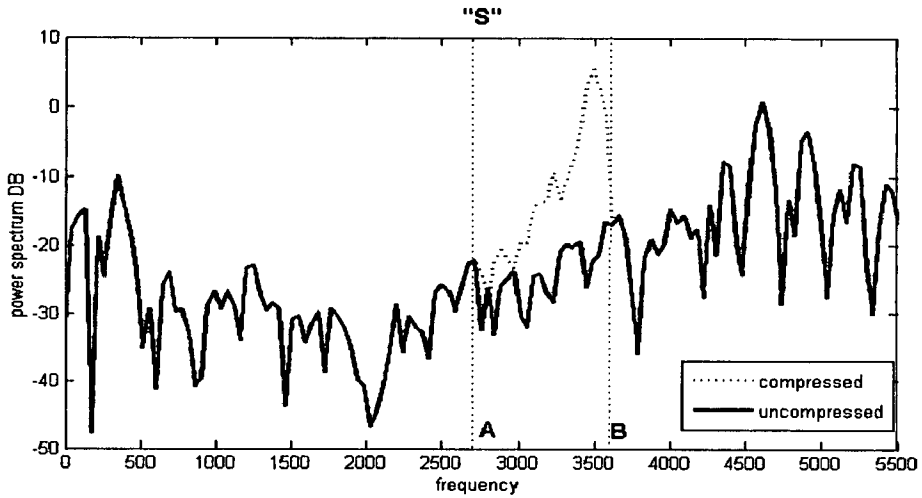
FIG. 2 is graph of uncompressed and compressed signals.

In FIG. 2, the spectral compressor 104 shown in FIG. 1 compresses and maps the frequency components between a designated cutoff frequency "A" and a Nyquist frequency to a band limited range that lies between cutoff frequencies "A" and "B." As shown, the compression of an unvoiced consonant (here the letter "S") that lies between about 2,800 Hz and about 5,550 Hz is compressed and mapped to a frequency range bounded by about 2,800 Hz and about 3,600 Hz. The frequency components that lie below cutoff frequency "A" are unchanged or are substantially unchanged. The bandwidth between about 0 Hz and about 3,600 Hz may coincide with the bandwidth of a telephone system or other communication systems. Other frequency ranges may also be used that coincide with other communication bandwidths.

Figure 3:
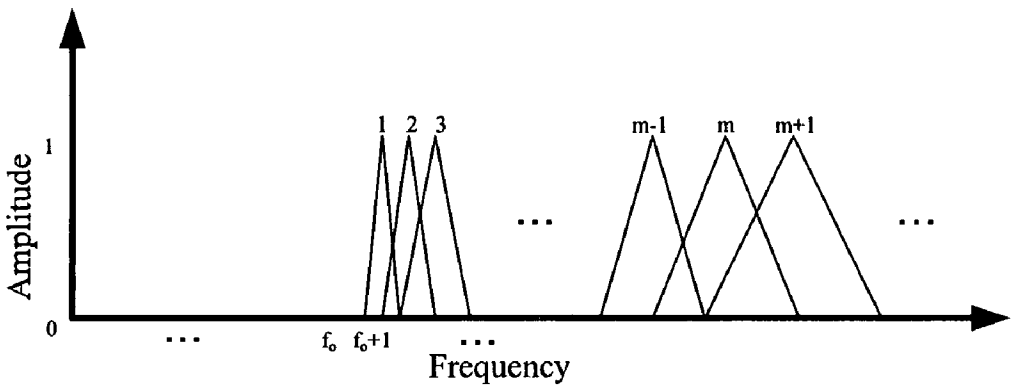
FIG. 3 is a graph of a group of basis functions.

One frequency compression scheme used by some enhancement systems combines a frequency compression with a frequency transposition. In these enhancement systems, an enhancement controller may be programmed to derive a compressed high frequency component. In some enhancement systems, equation 1 is used, where $C_m$ is the $$C_m = g_m \sum_{k=1}^{N} |S_k| \varphi_m(k) \qquad \text{(Equation 1)}$$

amplitude of compressed high frequency component, $g_m$ is a gain factor, $S_k$ is the frequency component of original speech signal, $\phi_m(k)$ is compression basis functions, and k is the discrete frequency index. While any shape of window function may be used as non-linear compression basis function ($\phi_m(k)$), including triangular, Hanning, Hamming, Gaussian, Gabor, or wavelet windows, for example, FIG. 3 shows a group of typical 50% overlapping basis functions used in some enhancement systems. These triangular shaped basis functions have lower frequency basis functions covering narrower frequency ranges and higher frequency basis functions covering wider frequency ranges.

The frequency components are then mapped to a lower frequency range. In some enhancement systems, an enhancement controller may be programmed or configured to map $$\begin{cases} \hat{S}_k = S_k & k = 1, 2, \ldots, f_o \\ \hat{S}_k = \dfrac{C_{k-f_o}}{|S_k|} S_k & k = f_o + 1, f_o + 2, \ldots, N \end{cases} \qquad \text{(Equation 2)}$$

the frequencies to the functions shown in equation 2. In equation 2, $\hat{S}_k$ is the frequency component of compressed speech signal and $f_o$ is the cutoff frequency index. Based on this compression scheme, all frequency components of the original speech below the cutoff frequency index $f_o$ remain unchanged or substantially unchanged. Frequency components from cutoff frequency "A" to the Nyquist frequency are compressed and shifted to a lower frequency range. The frequency range extends from the lower cutoff frequency "A" to the upper cutoff frequency "B" which also may comprise the upper limit of a telephone or communication pass-band. In this enhancement system, higher frequency components have a higher compression ratio and larger frequency shifts than the frequencies closer to upper cutoff frequency "B." These enhancement systems improve the intelligibility and/or perceptual quality of a speech signal because those frequencies above cutoff frequency "B" may carry significant consonant information, which may be critical for accurate speech recognition.

To maintain a substantially smooth and/or a substantially constant auditory background, an adaptive high frequency gain adjustment may be applied to the compressed signal. In FIG. 1, a gain controller 106 may apply a high frequency adaptive control to the compressed signal by measuring or estimating an independent extraneous signal such as a background noise signal in real time, near real time or delayed time through a noise detector 108. The noise detector 108 detects and may measure and/or estimate background noise. The background noise may be inherent in a communication line, medium, logic, or circuit and/or may be independent of a voice or speech signal. In some enhancement systems, a substantially constant discernable background noise or sounds is maintained in a selected bandwidth, such as from frequency "A" to frequency "B" of the telephone or communication bandwidth.

Figure 4:
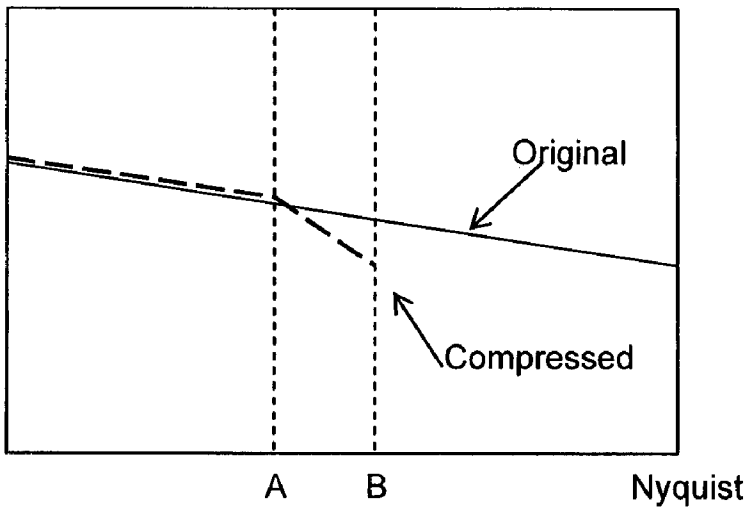
FIG. 4 is a graph of an original illustrative speech signal and a compressed portion of that signal.

The gain controller 106 may be programmed to amplify and/or attenuate only the compressed spectral signal that in some applications includes noise according to the function shown in equation 3. In equation 3, the output gain $g_m$ is derived by:

$$g_m = |N_{f_O+m}| \Big/ \sum_{k=1}^{N} |N_k| \varphi_m(k) \quad m = 1, 2, \ldots, M \qquad \text{(Equation 3)}$$

where $N_k$ is the frequency component of input background noise. By tracking gain to a measured or estimated noise level, some enhancements systems maintain a noise floor across a compressed and uncompressed bandwidth. If noise is sloped down as frequency increases in the compressed frequency band, as shown in FIG. 4, the compressed portion of the signal may have less energy after compression than before compression. In these conditions, a proportional gain may be applied to the compressed signal to adjust the slope of the compressed signal. In FIG. 4 the slope of the compressed signal is adjusted so that it is substantially equal to the slope of the original signal within the compressed frequency band. In some enhancement systems, the gain controller 106 will multiply the compressed signal shown in FIG. 4 with a multiplier that is equal to or greater than one and changes with the frequency of the compressed signal. In FIG. 4, the incremental differences in the multipliers across the compressed bandwidth will have a positive trend.

Figure 5:
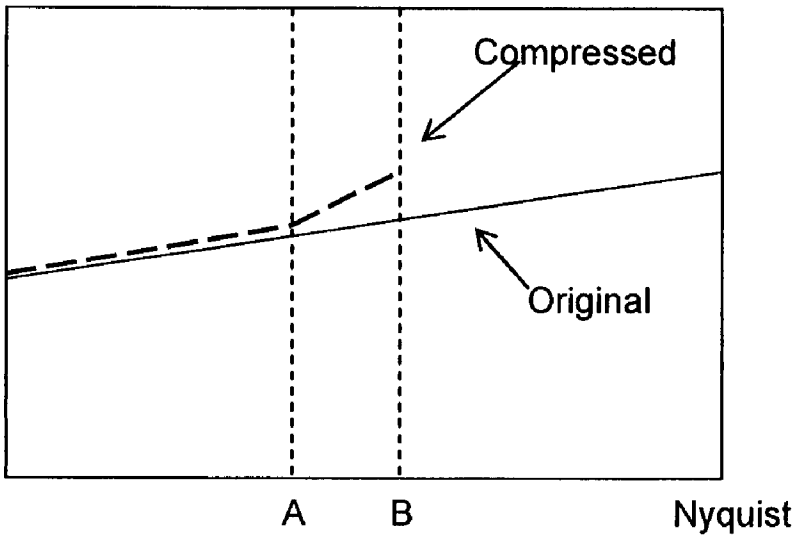
FIG. 5 is a second graph of an original illustrative speech signal and a compressed portion of that signal.

To overcome the effects of an increasing background noise in the compressed signal band shown in FIG. 5, the gain controller 106 may dampen or attenuate the gain of the compressed portion of the signal. In these conditions, the strength of the compressed signal will be dampened or attenuated to adjust the slope of the compressed signal. In FIG. 5, the slope is adjusted so that it is substantially equal to the slope of the original signal within the compressed frequency band. In some enhancement systems, the gain controller 106 will multiply the compressed signal shown in FIG. 5 with a multiplier that is equal to or less than about one but greater than zero. In FIG. 5, the multiplier changes with the frequency of the compressed signal. Incremental differences in the multiplier across the compressed bandwidth shown in FIG. 5 will have a negative trend.

Figure 6:
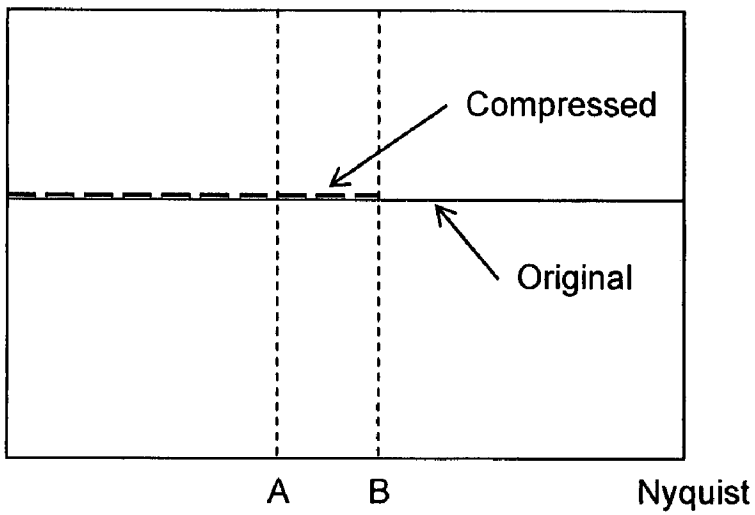
FIG. 6 is a third graph of an original illustrative speech signal and a compressed portion of that signal.

When background noise is equal or almost equal across all frequencies of a desired bandwidth, as shown in FIG. 6, the gain controller 106 will pass the compressed signal without amplifying or dampening it. In some enhancement systems, a gain controller 106 is not used in these conditions, but a preconditioning controller that normalizes the input signal will interface the front end of the speech enhancement system to generate the original input speech segment.

To minimize speech loss in a band limited frequency range, the cutoff frequencies of the enhancement system may vary with the bandwidth of the communication systems. In some telephone systems having a bandwidth up to approximately 3,600 Hz, the cutoff frequency may lie between about 2,500 Hz and about 3,600 Hz. In these systems, little or no compression occurs below the lowest cutoff frequency, while higher frequencies are compressed and transposed more strongly. As a result, lower harmonic relations that impart pitch and may be perceived by the human ear are preserved.

Further alternatives to the speech enhancement system or enhancement logic may be achieved by analyzing a signal-to-noise ratio (SNR) of the compressed and uncompressed signals. This alternative recognizes that the second formant peaks of vowels are predominately located below the frequency of about 3,200 Hz and their energy decays quickly with higher frequencies. This may not be the case for some unvoiced consonants, such as /s/, /f/, /t/, and /tʃ/. The energy that represents the consonants may cover a higher range of frequencies. In some systems, the consonants may lie between about 3,000 Hz to about 12,000 Hz. When high background noise is detected, which may be detected in a vehicle, such as a car, consonants may be likely to have higher Signal-to-Noise Ratio in the higher frequency band than in the lower frequency band. In this alternative, the average SNR in the uncompressed range $SNR_{A\text{-}B\ uncompressed}$ lying between cutoff frequencies "A" and "B" is compared to the average SNR in the would-be-compressed frequency range $SNR_{A\text{-}B\ compressed}$ lying between cutoff frequencies "A" and "B" by a controller. If the average $SNR_{A\text{-}B\ uncompressed}$ is higher than or equal to the average $SNR_{A\text{-}B\ compressed}$ then no compression occurs. If the average $SNR_{A\text{-}B\ uncompressed}$ is less than the average $SNR_{A\text{-}B\ compressed}$, a compression, and in some case, a gain adjustment occurs. In this alternative A-B represents a frequency band. A controller in this alternative may comprise a processor that may regulate the spectral compressor 104 through a wireless or tangible communication media such as a communication bus.

Another alternative speech enhancement system, enhancement logic, and method compares the amplitude of each frequency component of the input signal with a corresponding amplitude of the compressed signal that would lie within the same frequency band through a second controller coupled to the spectral compressor. In this alternative shown in equation 4, the amplitude $$|\hat{S}_{k\ output}| = \max(|S_k|, |\hat{S}_k|) \qquad \text{(Equation 4)}$$

of each frequency bin lying between cutoff frequencies "A" and "B" is chosen to be the amplitude of the compressed or uncompressed spectrum, whichever is higher.

Each of the controllers, systems, and methods described above may be encoded in a signal bearing medium, a computer readable medium such as a memory, programmed within a device such as one or more integrated circuits, or processed by a controller or a computer. If the methods are performed by software, the software may reside in a memory resident to or interfaced to the spectral compressor 104, noise detector 108, gain adjuster 106, frequency to time transformer 110 or any other type of non-volatile or volatile memory interfaced, or resident to the speech enhancement logic. The memory may include an ordered listing of executable instructions for implementing logical functions. A logical function may be implemented through digital circuitry, through source code, through analog circuitry, or through an analog source such through an analog electrical, or optical signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any apparatus that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection "electronic" having one or more wires, a portable magnetic or optical disk, a volatile memory such as a Random Access Memory "RAM" (electronic), a Read-Only Memory "ROM" (electronic), an Erasable Programmable Read-Only Memory (EPROM or Flash memory) (electronic), or an optical fiber (optical). A machine-readable medium may also include a tangible medium upon which software is printed, as the software may be electronically stored as an image or in another format (e.g., through an optical scan), then compiled, and/or interpreted or otherwise processed. The processed medium may then be stored in a computer and/or machine memory.

Figure 7:
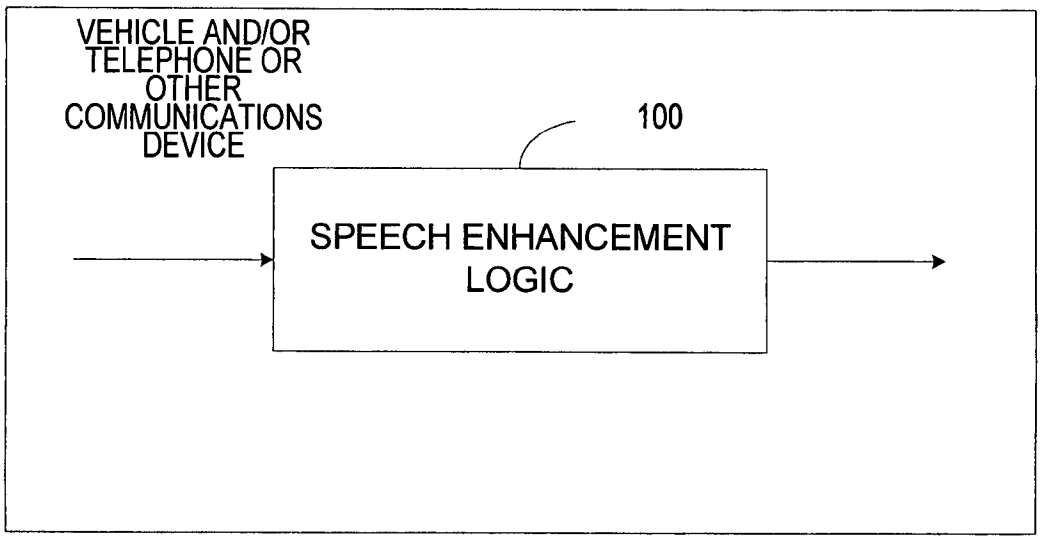
FIG. 7 is a block diagram of the speech enhancement system within a vehicle and/or telephone or other communication device.
Figure 8:
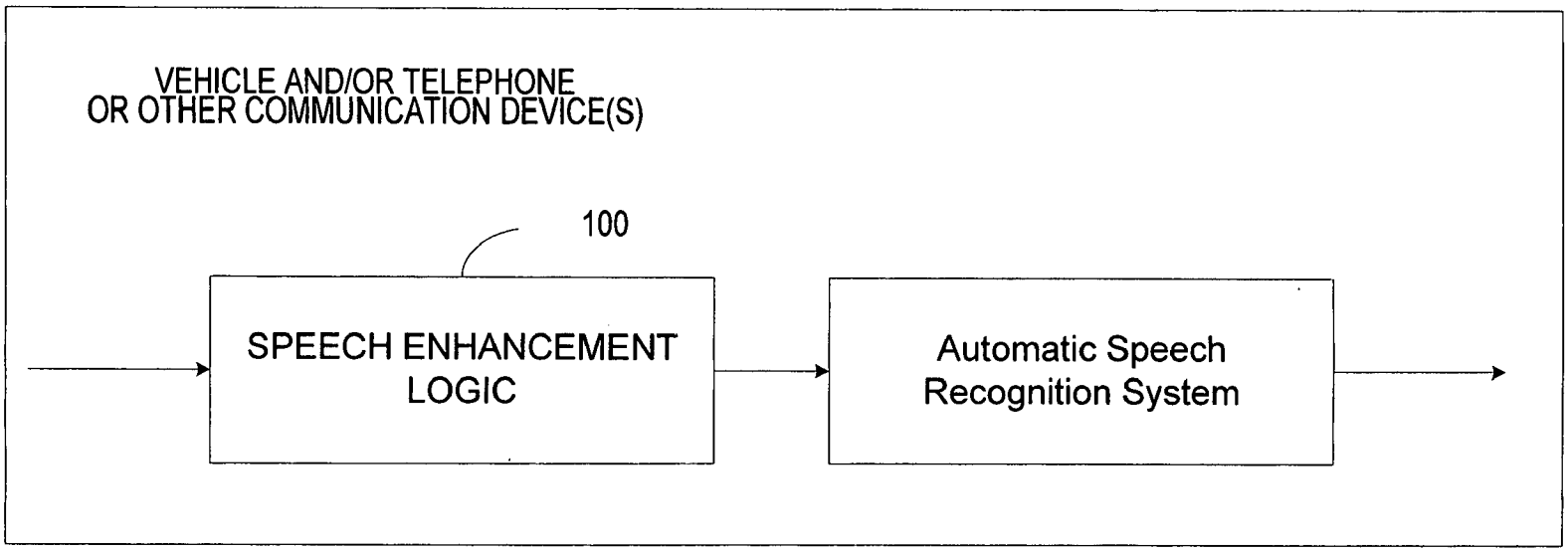
FIG. 8 is a block diagram of the speech enhancement system coupled to an Automatic Speech Recognition System in a vehicle and/or a telephone or other communication device.

The speech enhancement logic 100 is adaptable to any technology or devices. Some speech enhancement systems interface or are coupled to a frequency to time transformer 110 as shown in FIG. 1. The frequency to time transformer 110 may convert signal from the frequency domain to the time domain. Since some time-to-frequency transformers may process some or all input frequencies almost simultaneously, some frequency-to-time transformers may be programmed or configured to transform input signals in real time, almost real time, or with some delay. Some speech enhancement logic 100 or components interface or couple remote or local ASR engines as shown in FIG. 8 (shown in a vehicle that may be embodied in telephone logic or vehicle control logic alone). The ASR engines may be embodied in instruments that convert voice and other sounds into a form that may be transmitted to remote locations, such as landline and wireless communication devices that may include telephones and audio equipment and that may be in a device or structure that transports persons or things (e.g., a vehicle) or stand alone within the devices. Similarly, each of the speech enhancement systems or enhancement logic described may be embodied in personal communication devices including walkie-talkies, audio systems, Bluetooth enabled devices (e.g., headsets) outside or interfaced to a vehicle with or without ASR (as shown in FIG. 7) interfaced or integrated within an AEC, a fixed beamformer, an adaptive beamformer, or other signal processing devices or methods.

The speech enhancement logic is also adaptable and may interface systems that detect and/or monitor sound wirelessly or by an electrical or optical connection. When certain sounds are detected in a high frequency band, some systems may disable or otherwise mitigate the enhancement logic to prevent the compression, mapping, and in some instances, the gain adjustment of these signals. Through a bus, such as a communication bus, a noise detector may send an interrupt (hardware of software interrupt) or message to prevent or mitigate the enhancement of these sounds. In these applications, the enhancement logic may interface or be incorporated within one or more circuits, logic, systems or methods described in "System for Suppressing Rain Noise," U.S. Ser. No. 11/006,935, which is incorporated herein by reference. The enhancement logic 100 may process signals in a frequency range or bands that are not processed by the other systems. In some systems, the enhancement logic may process previously processed signals. These signals may lie within or outside of a band perceived by the ear (e.g., aural signals).

The enhancement logic 100 (e.g., hardware and/or software) may be implemented with other signal processing systems or applications such as a beamformer, an AEC, or other systems or applications that receive audio signals through a microphone, electronic device, or other sources The enhancement logic 100 may interface linear systems like some of the AECs, beamformers, and other linear or nonlinear methods.

In some configurations the enhancement logic 100 may operate within a frequency range that is much higher than the application the enhancement logic 100 interfaces. This may occur when the enhancement logic 100 interfaces an AEC, for example. In one system, the enhancement logic processes signals within a frequency band of about 0 kHz to about 11 kHz at a sampling rate of about 22 kHz. The enhancement logic may interface an AEC that operates within a lower frequency range. The frequency range of the AEC may vary from about 0 kHz to about 4 kHz. This range may include the frequency band of some telephone networks (e.g., about 300 Hz-3.4 kHz). In this example, the enhancement logic 100 and AEC share a common operating range that extends from about 0 Hz to about 4 kHz.

Figure 9:
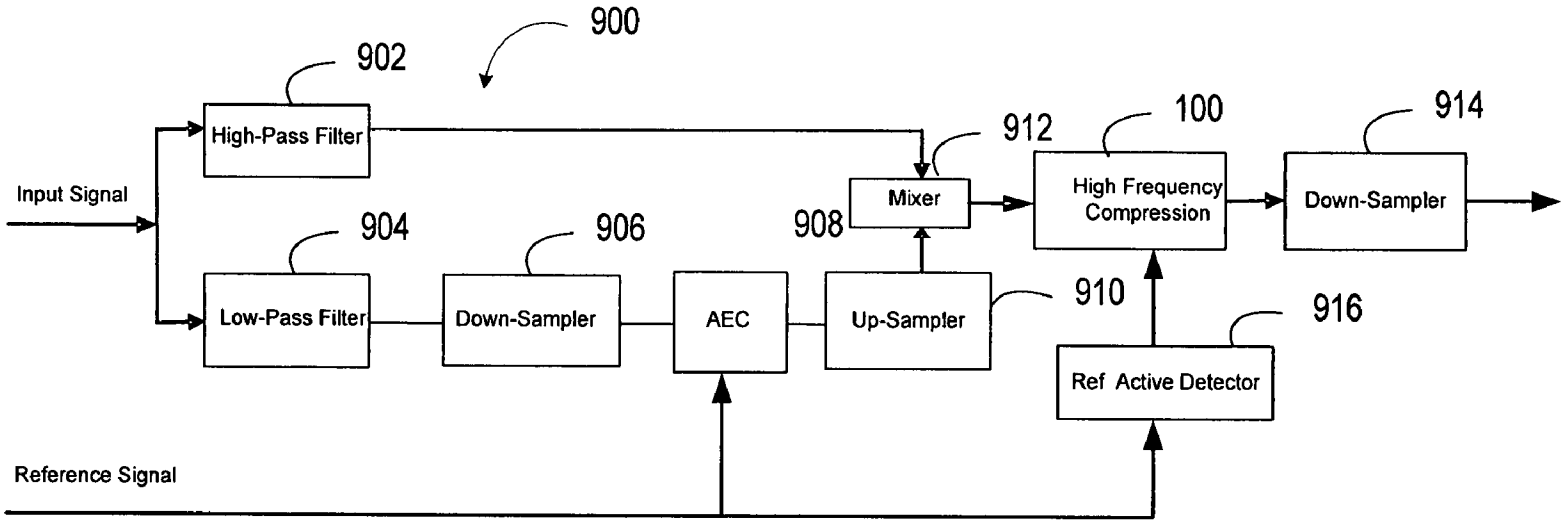
FIG. 9 is a block diagram of a speech enhancement system coupled to an acoustic echo canceller.

To avoid compressing echoes or repetitive sound created by reflections off one or more surfaces, the enhancement logic 100 processes the signals after some or nearly all of the echo components within a frequency band are dampened or substantially attenuated. In FIG. 9, the enhancement logic 100 interfaces an exemplary AEC 900 system. The AEC system 900 includes two paths: one having a filter that passes frequencies above a first frequency (e.g., a high pass filter 902) and a second path having a filter that passes frequencies below a second frequency (e.g., a lowpass filter 904). In FIG. 9, the first frequency and the second frequencies may be equal or substantially equal. If the frequencies occur at approximately 4 kHz and the input signal has a frequency range from about 0 kHz to 11 kHz, the high pass filter will pass a frequency band of about 4 kHz to about 11 kHz and the low pass filter will pass a frequency band of about 0 Hz to about 4 kHz.

In FIG. 9, an optional down-sampler 906 may convert the lowpass filtered signal to a lower sample rate signal. A down-sampler may be used when the AEC 908 processes a lower sample rate than the input sample rate to the lowpass filter. If the AEC 908 operates in a frequency band of about 0 Hz to about 4 kHz, the down-sampler may down sample the lowpass filtered 22 kHz signal to about 8 kHz or about 11 kHz. The AEC 908 dampens or substantially removes the unwanted echo components related to the reference signal to yield a cleaner signal before an up-sampler 910 converts the signal to a predetermined sampling rate. In FIG. 9 the sampling rate may be programmed or configured to sample at a substantially native sampling rate. If the input audio signal was sampled at about a 22 kHz rate, the up-sampler 910 may convert the echo cancelled signal to about a 22 kHz sample rate.

A mixer 912 or other device may combine the cleaner signals with the high pass filtered signals before it is processed by the enhancement logic 100. The enhancement logic 100 compresses a selected high frequency band and maps the compressed band to lower band limited frequency range. If a different sample rate is desired after the enhancement, another optional down-sampler 914 or an optional up sampler (not shown) may convert the enhanced output signal to a desired sample rate: In FIG. 9, the AEC 908 enhances the signal by removing the undesired echo components. The frequency compression of the enhancement logic 100 enhances the signal by shifting frequency from an upper band that may not otherwise be perceived to an aural range. An optional reference signal active detector 916 may be used to turn on or off the enhancement logic 100. When the reference channel signal is active, the enhancement logic 100 may be turned off to avoid compressing a residual echo signal.

Figure 10:
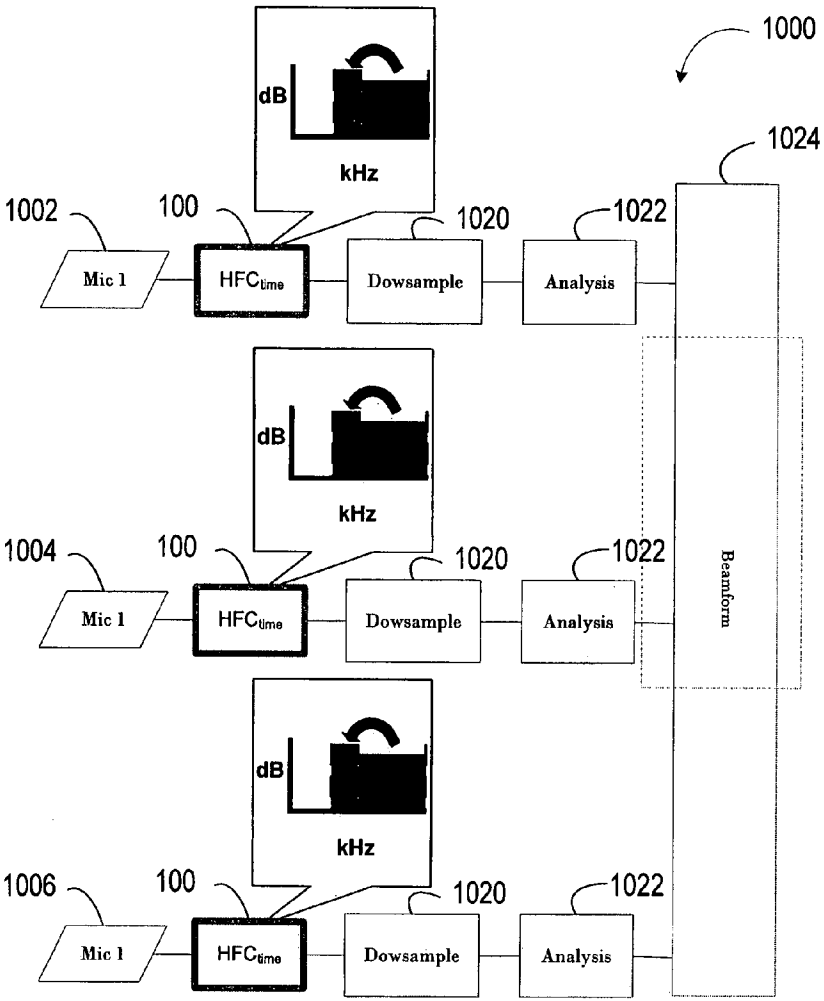
FIG. 10 is a block diagram of a speech enhancement system coupled to a beamformer.

In some configurations the enhancement logic 100 may also interface multiple systems or applications in an audio path. In FIG. 10, two, three, four, (1002, 1004, 1006, et al.) or more microphones may detect and convert sound waves into electrical signals. Hardware converts the output into digital data that is then processed by the enhancement logic 100. The enhancement logic 100 maps an upper frequency range to a lower frequency range. The exemplary sample rate of the digital signal is about a 22 kHz, frequency range that extends from about 5.5 kHz to about 11 kHz is compressed into about a 1.5 kHz frequency range (e.g., from about 4 kHz to about 5.5 kHz). A fixed beamformer 1024 may increase the clarity of wanted signals while decreasing the interference of the unwanted signals. An optional down-sampler 1020 may be used when the conditioning circuitry 1022 and beamformer 1024 are designed to only process lower sample rate (e.g., 11 kHz) signal. Using fixed weightings, time delays (e.g., phase shifts), or other circuits or techniques, the fixed beamformer 1024 of FIG. 10 may combine the signals to increase the gain of the wanted signals while lowering the gain of the signals traveling from the direction or origination of the interference or noise. While a fixed beamforming system 1024 is shown, an adaptive beamforming system or an adaptive beamforming technique may be used in alternative systems to improve the clarity of the desired signals.

Figure 11:
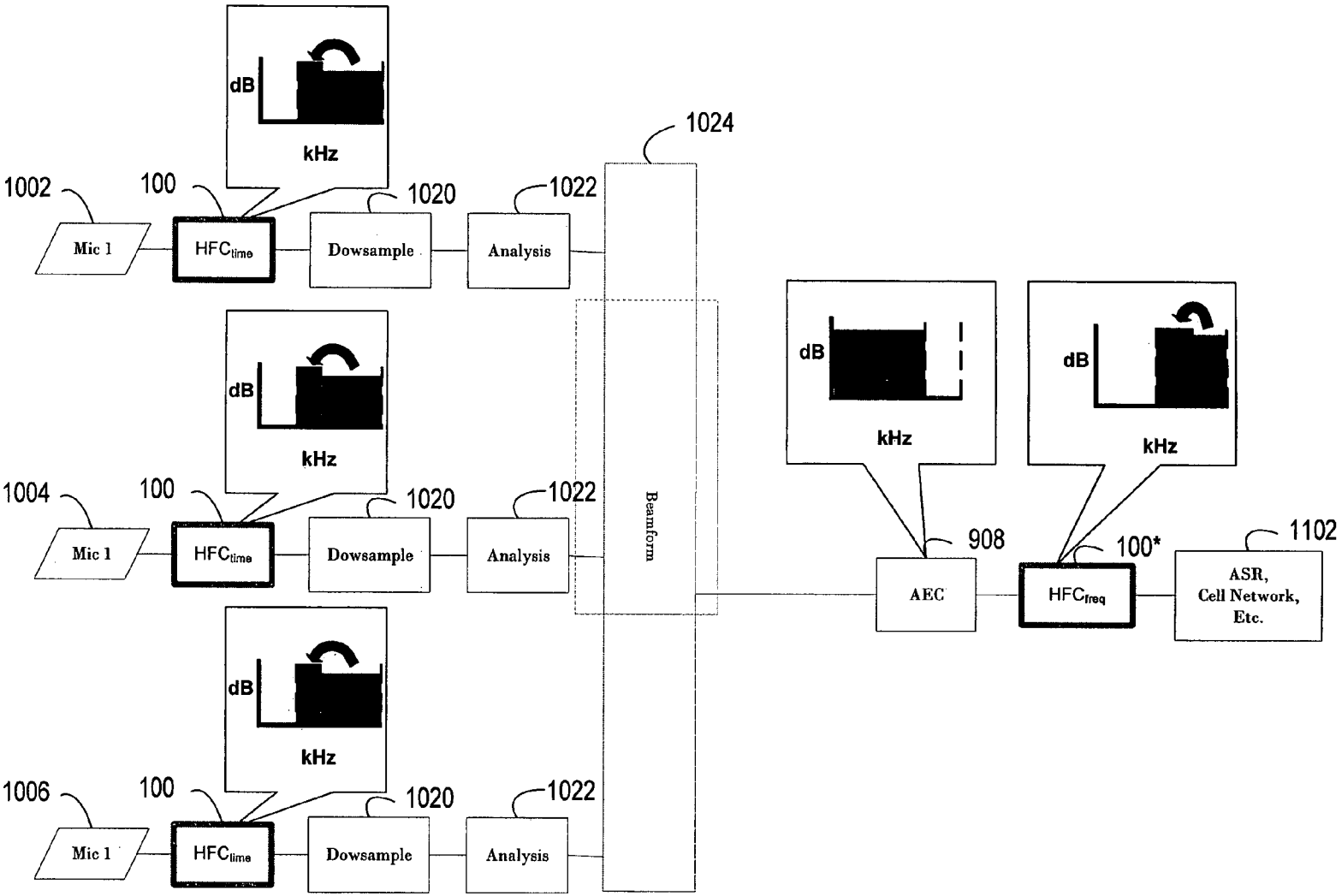
FIG. 11 is a block diagram of speech enhancement systems coupled to a beamformer and a acoustic echo canceller

The enhanced signal processed in FIG. 10 may be further processed to remove undesired echo components as shown in FIG. 11. In FIG. 11, the intermediate enhancement logic (the first enhancement logic shown in FIG. 11) does not compress the upper frequency band to a frequency range that may be modified entirely or in part by a successive system or process (the AEC 908 in FIG. 11). By doing so, the logic minimizes or prevents the modification of common signals by the intermediate enhancement logic and a successive system.

In FIG. 11 the first enhancement logic 100 (the intermediate enhancement logic) does not compress the energy found in about the 5.5 kHz to about the 11 kHz range to a frequency range below about 4 kHz (a predetermined threshold). The restraint minimizes the modification of signals lying within an overlapping frequency range. Without examining the upper frequency band, the AEC 908 may remove or substantially dampen the unwanted echo components that occur below 4 kHz (a band limited frequency range). With the echo components removed or substantially dampened below 4 kHz, a second enhancement logic 100* may map the previously compressed frequency range, to a lower, and in some applications, a narrower frequency range that may overlap with a frequency range modified by a prior signal processing system or process (e.g., the AEC). In FIG. 11, the exemplary frequency range that extends from about 4 kHz to about 5.5 kHz is compressed into about a 1.2 kHz frequency range (e.g., from about 2.8 kHz to about 4 kHz). The interfaced systems of FIG. 11 may interface many other communication devices. An ASR, a wireless network, or the other wired or wireless communications systems some of which are referenced 1102 in FIG. 11 may process the enhanced output of these systems.

Figure 12:
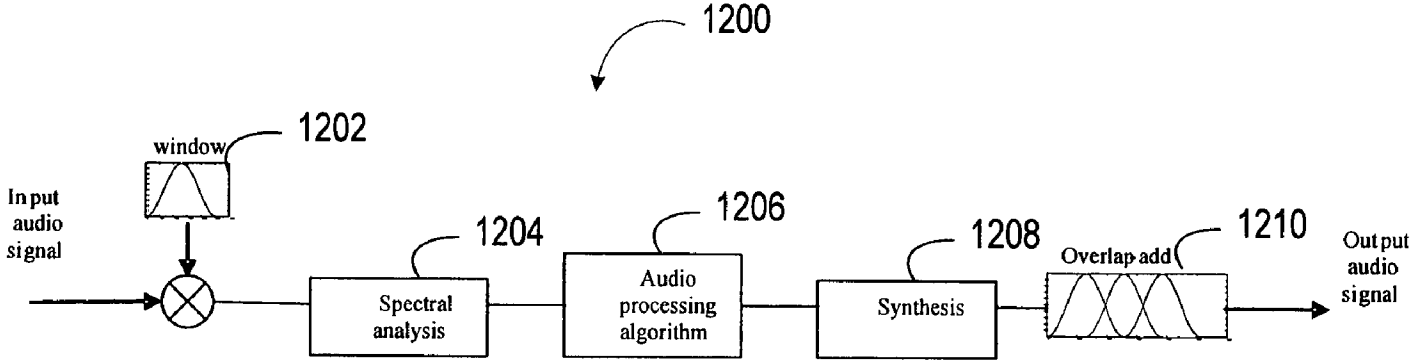
FIG. 12 is an exemplary block diagram of an audio processing system.

Some audio processing systems 1200 apply a window function 1202, analyze 1204, and process the windowed spectrum 1206 before synthesizing 1208 the signal back to the time domain as shown in FIG. 12. A reconstructed signal may be created through an overlap and add method (or through an adder 1210 programmed to overlap and add) that may introduce processing delays. Since the window functions used during this analysis overlap, the frame shift in these systems may be less than the window size, (half the window size in some systems), and the processing delay may be inversely proportional to the frame shift.

Because many high frequency speech components resemble random noise and the human auditory system has a lower frequency resolution above a threshold, such as 2.5 kHz for example, an alternative audio processing or speech enhancement system may use a window length equal to or nearly equal to the length of the frame shift. In this alternative system, an overlap and add function may not be needed to reconstruct the output signal. Without reconstructing the signal through the weighting and time shifts introduced by an overlap and add function, processing delays may be minimized and processing loads reduced.

Figure 13:
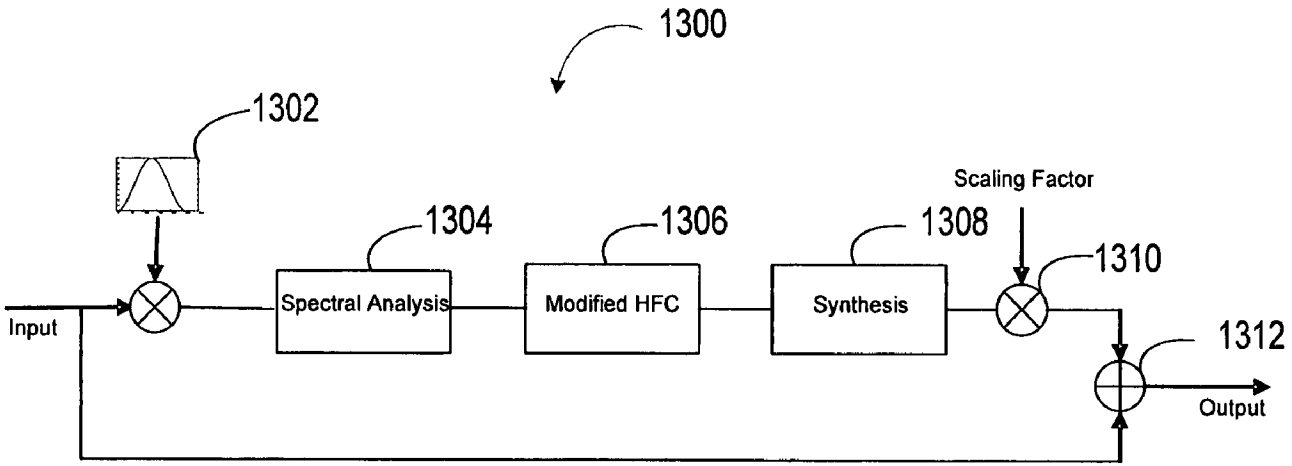
FIG. 13 is an exemplary block diagram of a speech enhancement system coupled to an audio processing system.
Figure 14:
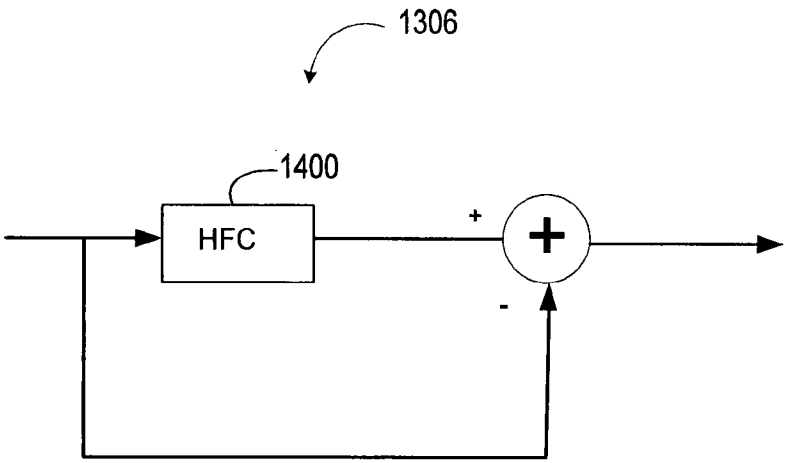
FIG. 14 is a block diagram of a portion of an enhancement of FIG. 13.

FIG. 13 is an exemplary block diagram of an alternative speech enhancement system 1300 coupled to an audio processing system. In an upper path, an audio signal is first processed by a window function 1302 followed by spectral analysis by a spectral analyzer 1304 and a modified enhancement logic 1306. In this alternative system, the modified enhancement logic 1306 calculates or estimates a difference between a compressed and uncompressed spectrum as shown in FIG. 14. The difference is synthesized through a synthesizer 1308 with a random phase. A scaling factor and multiplier 1310 compensates for the energy loss before the signal is added to the original audio signal from the lower path by an adder 1312. By using random phase the synthesized signal may have a substantially rectangular window like shape, and therefore, weighting and time shifts (such as an overlap and add function) may not be needed to reconstruct the signal.

The enhancement logic improves the intelligibility of speech signals. The logic may automatically identify and compress speech and other audio segments to be processed. Selected voiced and/or unvoiced segments may be processed and shifted to one or more frequency bands. To improve perceptual quality, adaptive gain adjustments may be made in the time or frequency domains. The system may adjust the gain of only some of or the entire speech segments with some adjustments based on a sensed or estimated signal. The versatility of the system allows the logic to enhance speech before or after it is passed or processed by a second system. In some applications, speech or other audio signals may be passed to remote, local, or mobile ASR engine, acoustic echo canceller, beamformer, or other systems that may capture and extract voice in the time and/or frequency domains. Some speech enhancement systems do not switch between speech and silence or voiced and unvoiced segments and thus are less susceptible the squeaks, squawks, chirps, clicks, drips, pops, low frequency tones, or other sound artifacts that may be generated within some speech systems that capture or reconstruct speech. Some systems to minimize the processing delay caused by some compression.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A speech system that improves the intelligibility and quality of a processed speech, comprising:

a first spectral compressor that compresses a first pre-selected high frequency band and maps the first compressed high frequency band to a first band limited lower frequency range;

an acoustic echo canceller coupled with an output of the first spectral compressor to receive a first sound signal modified by the first spectral compressor, where the acoustic echo canceller dampens repetitive sounds in the first sound signal created by a reflection from a surface; and a second spectral compressor coupled with an output of the acoustic echo canceller to receive a second sound signal modified by the acoustic echo canceller, where the second spectral compressor compresses a second pre-selected high frequency band of the second sound signal and maps the second compressed high frequency band to a second lower band limited frequency range, and where the second spectral compressor comprises circuitry or a computer-readable storage medium that stores instructions executable by a processor.

2. The system of claim 1, further comprising a frequency converter coupled with the first spectral compressor or the second spectral compressor, where the frequency converter is programmed to automatically convert a speech signal into its frequency spectrum in nearly real time.

3. The system of claim 1, further comprising a frequency converter coupled with the first spectral compressor or the second spectral compressor, where the frequency converter is programmed or configured to automatically convert a speech signal into a spectrum of frequencies in real time.

4. The system of claim 1, where the first high frequency band comprises a larger range of frequencies than the first lower band limited frequency range.

5. The system of claim 1 where the first spectral compressor or the second spectral compressor comprises a non-linear compression basis function, and where the acoustic echo canceller comprises a device that dampens the repetitive sounds.

6. The system of claim 1 where the second lower band limited frequency range comprises a portion of an analog bandwidth.

7. The system of claim 1 where the second lower band limited frequency range comprises a portion of a telephone bandwidth.

8. The system of claim 1 further comprising a noise detector configured to detect and measure a level of noise present in a speech signal received at an input of the first spectral compressor or the second spectral compressor.

9. The speech system of claim 8, further comprising a gain controller configured to apply a variable gain to the first compressed high frequency band or the second compressed high frequency band, where the gain controller is configured to select a level for the variable gain based on the measured level of noise present in the speech signal.

10. The system of claim 1 further comprising a noise detector configured to detect and estimate a level of noise present when a speech signal is detected.

11. The system of claim 1 further comprising a gain controller configured to adjust a gain of the first compressed high frequency band or the second compressed high frequency band in relation to an independent extraneous signal.

12. The system of claim 11 where the independent extraneous signal comprises a background noise.

13. The system of claim 1 further comprising a gain controller coupled to the first spectral compressor, where the gain controller is configured to adjust only the gain of the first compressed high frequency band at the first lower band limited frequency range.

14. The system of claim 13 where the gain controller is configured to apply a plurality of gain adjustments that varies with a signal independent of a detected speech signal.

15. The speech system of claim 1, where the first lower band limited frequency range is different than the second lower band limited frequency range.

16. The speech system of claim 1, further comprising a gain controller configured to adjust a gain of the first compressed high frequency band or the second compressed high frequency band, and where the gain controller is configured to select a level for the gain based on a change in power level in the first compressed high frequency band or the second compressed high frequency band due to the compression of the first pre-selected high frequency band or the second pre-selected high frequency band into the first lower band limited frequency band or the second lower band limited frequency band.

17. The speech system of claim 1, further comprising a gain controller configured to adjust a gain of the first compressed high frequency band or the second compressed high frequency band, and where the gain controller is configured to select a level for the gain that substantially aligns a slope of a noise floor present in the first compressed high frequency band or the second compressed high frequency band with a slope of a noise floor present in an uncompressed frequency band.

18. A speech system that improves the intelligibility of a processed speech, comprising:

a high pass filter that passes frequencies above a first frequency;

a low pass filter in communication with the high pass filter that passes frequencies below a second frequency;

an acoustic echo canceller in communication with the low-pass filter that dampens repetitive sounds created by a reflection from a surface;

a mixer that combines an output of the acoustic echo canceller with an output of the high pass filter;

a frequency transformer that converts an output of the mixer into its frequency domain;

a spectral compressor coupled to the frequency transformer that compresses a pre-selected high frequency band of a first signal and maps the compressed high frequency band to a lower frequency band; and a gain controller configured to adjust a gain of the compressed high frequency band proportionally to the changing level of an independent and extraneous signal, where the gain controller selects a level for the gain that changes across a frequency range of the compressed high frequency band based on a slope of a noise floor present in an uncompressed frequency band of the first signal and a slope of a noise floor present in the compressed high frequency band of the first signal, and where the gain controller comprises circuitry or a computer-readable storage medium that stores instructions executable by a processor.

19. The speech system of claim 18 further comprising a controller that regulates the spectral compressor, the controller comprising a monitor that compares a signal-to-noise ratio of the compressed signal to a signal-to-noise ratio of the signal before it is compressed.

20. The speech system of claim 18 where the gain controller is configured to apply a gain that varies with a changing level of the extraneous signal.

21. The speech system of claim 18 further comprising a beamformer in communication with the gain controller that increases a gain of a desired range of signals while lowering a gain of a signal traveling from an originating source of noise.

22. A speech system that improves the intelligibility of a processed speech, comprising:

a plurality of devices that detect and convert sound waves into electrical signals;

a plurality of frequency transformers that convert an output of one of the plurality of devices into its frequency domain;

a plurality of first spectral compressors, each of the first spectral compressors being in communication with one of the plurality of frequency transformers, and each of the first spectral compressors being configured to compress a first pre-selected high frequency band and map the first compressed high frequency band to a first lower frequency band;

a plurality of noise detectors each configured to detect and estimate a level of noise present in at least one of the sound waves detected by the respective plurality of devices and compressed by the respective plurality of spectral compressors;

a plurality of gain controllers each configured to adjust a gain of at least one of the compressed high frequency bands proportionally to the level of noise present in at least one of the sound waves detected by the respective plurality of devices and compressed by the respective plurality of spectral compressors;

a beamformer configured to receive signals processed by the plurality of first spectral compressors and the plurality of gain controllers;

an acoustic echo canceller configured to receive an output signal of the beamformer; and a second spectral compressor configured to receive an output signal of the acoustic echo canceller, compress a second pre-selected high frequency band of the output signal of the acoustic echo canceller, and map the second compressed high frequency band to a second lower frequency band.

23. The speech system of claim 22 further comprising a plurality of frequency to time transformers each in communication with at least one of the plurality of gain controllers and the beamformer.

24. The speech system of claim 19 further comprising:

an additional frequency transformer that converts an output of the acoustic echo canceller into a frequency domain;

an additional noise detector configured to detect and estimate a second level of noise present in the output of the acoustic echo canceller; and an additional gain controller configured to adjust the gain of the second compressed high frequency band proportionally to the second level of noise present in the output of the acoustic echo canceller.

25. The speech system of claim 22, where at least one of the plurality of spectral compressors comprises circuitry or a computer-readable storage medium that stores instructions executable by a processor.

26. A speech system that improves the intelligibility of a processed speech, comprising:

a beamformer that passes selected audio signals received from a plurality of receivers;

a frequency transformer that converts speech signals from time domain into frequency domain in real time;

a spectral compressor coupled to the frequency transformer that compresses a pre-selected high frequency band of a signal and maps the compressed high frequency band to a lower frequency band within a telephone pass band;

a noise detector configured to detect and measure a background noise level of speech signals; and a gain controller configured to apply a variable gain to the compressed high frequency band in relation to the level of the background noise, where the gain controller is configured to select a level for the variable gain that substantially aligns a slope of a noise floor present in the compressed high frequency band of the signal with a slope of a noise floor present in an uncompressed frequency band of the signal, where the gain controller comprises circuitry or a computer-readable storage medium that stores instructions executable by a processor.

27. The speech system of claim 26 further comprising a controller that regulates the spectral compressor through a communication bus, the controller compares a signal-to-noise ratio of a portion of the detected speech signal to a signal-to-noise ratio of a portion of the compressed signal.

28. The speech system of claim 27 where the controller is programmed to compare amplitude through a comparison of frequency bins.

29. The speech system of claim 27 further comprising an automatic speech recognition system coupled to the gain controller.

* * * * *

UNITED STATES PATENT AND TRADEMARK OFFICE

CERTIFICATE OF CORRECTION

PATENT NO. : 8,249,861 B2
APPLICATION NO. : 11/645079
DATED : August 21, 2012
INVENTOR(S) : Xueman Li et al.

It is certified that error appears in the above-identified patent and that said Letters Patent is hereby corrected as shown below:

In the Claims

In column 14, claim 24, line 5, after "The speech system of claim" replace "19" with --22--.

Signed and Sealed this
Nineteenth Day of February, 2013

Teresa Stanek Rea
*Acting Director of the United States Patent and Trademark Office*